US005203308A

United States Patent [19]

Liskow

[11] Patent Number: 5,203,308

[45] Date of Patent: Apr. 20, 1993

[54] DEVICE FOR INJECTING A FUEL-GAS MIXTURE

[75] Inventor: Uwe Liskow, Kornwestheim, Fed. Rep. of Germany

[73] Assignee: Robert Bosch GmbH, Stuttgart, Fed. Rep. of Germany

[21] Appl. No.: 775,982

[22] PCT Filed: Feb. 23, 1991

[86] PCT No.: PCT/DE91/00151

§ 371 Date: Nov. 20, 1991

§ 102(e) Date: Nov. 20, 1991

[87] PCT Pub. No.: WO91/14865

PCT Pub. Date: Oct. 3, 1991

[30] Foreign Application Priority Data

Mar. 23, 1990 [DE] Fed. Rep. of Germany ..... 4009320

[51] Int. Cl.[5] ..... F02M 67/00; F02M 69/08; F02M 69/50

[52] U.S. Cl. ..... 123/531

[58] Field of Search ..... 123/531, 533, 532, 534

[56] References Cited

U.S. PATENT DOCUMENTS 4,708,117 11/1987 Mesenich et al. ..... 123/531

4,709,681 12/1987 Rozsas ..... 123/533

*Primary Examiner*—Andrew M. Dolinar

*Attorney, Agent, or Firm*—Edwin E. Greigg; Ronald E. Greigg

[57] ABSTRACT

A device for injecting a fuel-gas mixture in which the fuel stream is injected via injection ports of a fuel injection valve into distributor openings of a distributor line in a distributor housing. The fuel streams are injected in aimed fashion from the injection ports via fuel transport conduits into the distributor openings, which has an advantage of accurate fuel allocation to the various distributor openings and of maximally homogeneous mixture formation. The gas for the gas-fuel mixture flows out of a central gas delivery opening via a gas distributor chamber and via a respective gas gap to one distributor opening each, where it envelops the applicable fuel stream in which the gas and fuel is conducted to an intake tube or directly into the cylinder.

19 Claims, 5 Drawing Sheets

DEVICE FOR INJECTING A FUEL-GAS MIXTURE

BACKGROUND OF THE INVENTION

The invention is based on a device for injecting a fuel-gas mixture as defined hereinafter. German Patent Application P 39 31 490.1 has already proposed a device for injecting a fuel-gas mixture having a distributor housing that has a gas delivery opening extending concentrically with a longitudinal valve axis, as well as distributor openings aimed at injection ports of a fuel injection valve; the gas delivery opening communicates with the distributor openings. However, the fuel stream is injected from the injection ports into the distributor openings not directly but rather in the form of a free stream, so that peripheral mists of fuel and portions of the core stream strike the inner walls of the distributor housing. Since moreover the fuel stream is not enveloped by the gas stream and the gas speed is low, the gas in this distributor chamber formed by the distributor housing and the fuel injection valve does not exert any substantial aiming effect on the fuel. Especially if the fuel injection valve is in an inclined position, the danger exists that the film of fuel on the wall in the peripheral region of the gas flow will flow back upstream to the gas delivery opening or will reach some other distributor opening. Fuel can become deposited in the corners or edges of the distributor chamber and can cause disruptive dribbling, for instance after the fuel injection valve has been switched off.

In the device proposed in German Patent Application P 39 31 490.1, reliable, exact fuel metering to the various distributor openings is therefore not always assured.

ADVANTAGES OF THE INVENTION

The device according to the invention for injecting a fuel-gas mixture has an advantage over the prior art of particularly accurate allocation of fuel to the various distributor openings or to the various cylinders of an engine, and of maximally homogeneous mixture formation. The aimed fuel stream is injected through the injection ports of the injection end into the distributor openings of the distributor housing via the fuel transport conduits and is transported onward all the way downstream by the gas delivered via the gas gap, thereby preventing the formation of a fuel film on the inner walls of the distributor housing.

In the mixture formation zone, virtually no corners, edges or gaps in which fuel can become deposited are formed; after the shutoff of the fuel injection valve, for instance, such deposits cause disruptive dribbling and nonhomogeneous formation of the fuel-gas mixture.

Advantageous further developments of and improvements to the device disclosed are possible with the provisions recited herein.

It is advantageous if the gas gap, at its narrowest point, has a smaller cross-sectional area than the gas delivery opening. Because of the throttling of the gas flow, making the gas gap narrow not only permits metering of the gas to the various distributor openings but also accelerates the gas to a high speed in the direction of the distributor openings, which improves mixture formation and prevents the fuel from flowing back upstream.

For a particularly simple embodiment of the fuel transport conduits and gas gaps, it is advantageous if the valve cap is provided with a number of frustoconical projections, corresponding to the number of distributor openings and each aimed at a respective distributor opening; the fuel transport conduits extend through these projections, which protrude into frustoconical indentations of the distributor housing with a spacing such that the at least partially encompassing gas gaps are formed between the circumference of the projections and the surface of the indentations.

It is advantageous if the gas delivery opening communicates with the gas gap through a gas distributor chamber embodied concentrically with the longitudinal valve axis between the valve cap and the distributor housing, so that a particularly uniform delivery of the gas to the gas gaps takes place.

It is especially advantageous if the smallest diameter of the projection is smaller than the diameter of the distributor opening, so that the projection advantageously protrudes into the distributor opening.

As an alternative to embodying the gas gap by the advantageous if a frustoconical jacket of the projection is embodied in stepped fashion and rests with a first step on the indentation of the distributor housing and with a second step along with a wall of the indentation forms the gas gap. This embodiment enables particularly exact and uniform embodiment of the gas gaps, because of the numerous bearing faces of the valve cap on the distributor housing.

It is advantageous if one gas conduit each, extending between the valve cap and the distributor housing, leads from the gas delivery opening to each gas gap, enabling exact gas delivery to the applicable gas gap and making possible a larger bearing face of the valve gap extending at right angles to the longitudinal valve axis, on the distributor housing.

It is advantageous if the cone angle of the frustoconical projection of the valve cap is smaller than the cone angle of the frustoconical indentation of the distributor housing, so that the gas undergoes high, continuous acceleration until it enters a mixture formation zone, formed by the region of the distributor opening aimed at the injection port of the fuel injection valve. This also facilitates installing the valve cap in the distributor housing. Except in the immediate region of the distributor openings, the dimensional and positional tolerances of the projections and indentations can be designed more generously.

It is also advantageous if the fuel transport conduit is embodied in a fuel tubule that extends through the valve cap. This makes simple production of the valve cap possible, since fine machining of the fuel transport conduits becomes unnecessary, and tubular material that can be cut to the proper length is used instead.

It is advantageous if the fuel tubule protrudes into the indentation of the distributor housing and if the at least partially encompassing gas gap is formed between the surface of the indentation and the circumference of the fuel tubule. As a result, the valve cap is particularly simple to produce, with wide production tolerances on its circumference.

It is advantageous if the outer diameter of the fuel tubule is smaller than the diameter of the distributor opening.

For exact, concentric support of the fuel injection valve on the valve cap, it is advantageous if the frustoconical injection end of the valve housing rests on a frustoconical bearing face of the valve cap.

For supporting the valve cap on the distributor housing and for embodying the vairous gas gaps exactly and uniformly, it is especially advantageous if the valve cap rests with a collar on a shoulder of the distributor housing.

In order to prevent twisting of the fuel injection valve relative to the valve cap and thus to assure aiming of the injection ports of the injection end at the fuel transport conduits of the valve cap, it is advantageous if the valve cap position with respect to the valve housing is determined by a circumferentially form fitting connection between the valve cap and the valve housing.

It is likewise advantageous if the valve cap position with respect to the distributor housing is determined by a circumferentially form-fitting connection between the valve cap and the distributor housing, which prevents twisting of the valve cap relative to the distributor housing and thus assures the aiming of the fuel transport conduits at the distributor openings of the distributor housing.

DRAWING

Exemplary embodiments of the invention are shown in simplified form in the drawing and described in further detail in the ensuing description. FIG. 1 shows a first exemplary embodiment, with a fuel injection valve shown in fragmentary form; FIG. 2 is a view of the valve cap in the direction of the arrow X of the first exemplary embodiment; FIG. 3 shows a second exemplary embodiment with a fuel injection valve shown in fragmentary form; FIG. 4 is a view of the distributor housing in the direction of the arrow Y of the second exemplary embodiment; FIG. 5 shows a third exemplary embodiment; and FIG. 6 shows a fourth exemplary embodiment.

DESCRIPTION OF THE EXEMPLARY EMBODIMENTS

Figure 1:
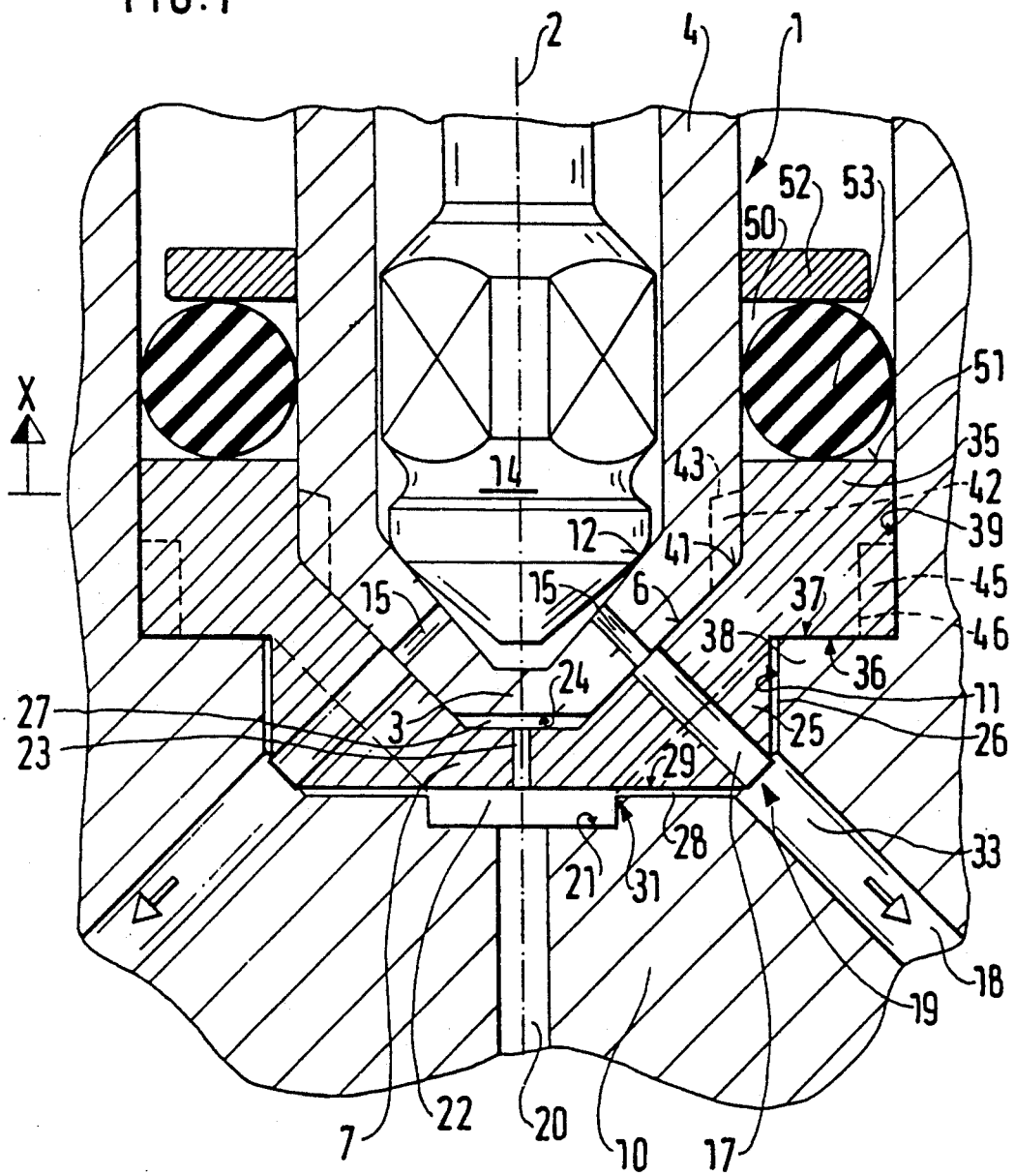

The device for injecting a fuel-gas mixture into an intake tube or directly into the cylinders of an internal combustion engine, shown by way of example in FIG. 1 in longitudinal section and in fragmentary form, has a fuel injection valve 1, which with its frustoconical injection end, embodied concentrically with a longitudinal valve axis 2 of a valve housing 4, rests on a frustoconical bearing face 6 of a valve cap 7, resulting in simple yet very exact centering of the fuel injection valve relative to the valve cap 7. At least in the axial direction, the valve cap 7 is disposed between the injection end 3 of the fuel injection valve 1 and a distributor housing 10, which fits around a stepped longitudinal bore 11 of the injection end 3, the valve cap 7, and at least part of the fuel injection valve 1.

A fuel injection valve 1 has a valve closing body 14 cooperating with a fixed valve seat 12 and actuatable as a function of operating state. Downstream of the valve seat 12, the injection end 3 of the fuel injection valve 1 has a number of injection ports 15, for example four of them, corresponding to the number of engine cylinders or injection groups, each group including a plurality of engine cylinders. A number of fuel transport conduits 17, open on both ends, corresponding to the number of injection ports 15 and aimed at them, is embodied in the valve cap 7; each of these conduits discharge into one distributor opening 19 disposed in the distributor housing 10 concentrically with the injection ports 15. Beginning at the distributor openings 19, distributor lines 18 aimed at the fuel transport conduits 17 extend within the distributor housing 10.

A gas delivery opening 20 extends in the distributor housing 10 concentrically with the longitudinal valve axis 2 and is adjoined axially by a ga distributor chamber 22 embodied between the valve cap 7 and the distributor housing 10 in a recess 21 of the distributor housing 10. The gas distributor chamber 22 furnishes part of the connection between the central gas delivery opening 20 and the various distributor openings 19.

To prevent the fuel stream from striking the walls of the fuel transport conduit 17 and/or the walls of the distributor opening 9 or distributor line and thus to prevent a fuel film from settling on the walls and hindering the formation of a desired mixture, the cross-sectional area of the fuel transport conduit 17 is a least precisely as large as the cross-sectional area of the injection port 15, and the cross-sectional area of the distributor opening 19 is at least precisely as large as the cross-sectional area of the fuel transport conduit 17.

A compensation bore 23 having a cross-sectional area substantially smaller than the gas delivery opening 20 is embodied in the valve cap 7, also concentrically with the longitudinal valve axis 2. The compensation bore 23 connects the gas distributor chamber 22 to a compensation chamber 27 embodied between an end face 24 of the injection end 3 of the fuel injection valve 1 and the valve cap 7. When the fuel injection valve 1 is installed against the valve cap 7, it is thus attained that the air located between the fuel injection valve 1 and the valve cap 7 can escape through the compensation bore 23. If leakage unexpectedly occurs between the fluid-tight contact of the fuel injection valve 1 with the valve cap 7 during operation of the device according to the invention, then the mist of fuel passes through the compensation bore 23 into the gas distributor chamber 22 and from there is entrained by the gas flow to the distributor openings 19.

The valve cap 7 is provided with a number of frustoconical projections 25, corresponding to the number of distributor openings 19 and each aimed at one distributor opening 19; the fuel transport conduits 17 extend concentrically through these projections. With their frustoconical jacket 29, the projections 25 protrude into frustoconical indentations 26 of the distributor housing 10, with a spacing between them such that a narrow, encompassing gas gap 28 is formed between the circumference of the projections 25 and the surface of the indentations 26, so that after emerging from the fuel transport conduit 17, the fuel stream is fully enveloped by a gas stream. Each gas gap 28 extends from the gas distributor chamber 22 to a respective distributor opening 19, forming the bottom of an indentation 26. If the ratio between the narrowest area of the gas gap 28 and the distributor opening 19 is overly low, the danger exists that the quantity of fuel injected by the injection ports 15 of the fuel injection valve will be affected by the feedback from the gas flow. The projections 25 with the fuel transport conduits 17 may terminate immediately above, at the same height as, or, as shown in the drawing, inside the distributor openings 19.

Figure 2:
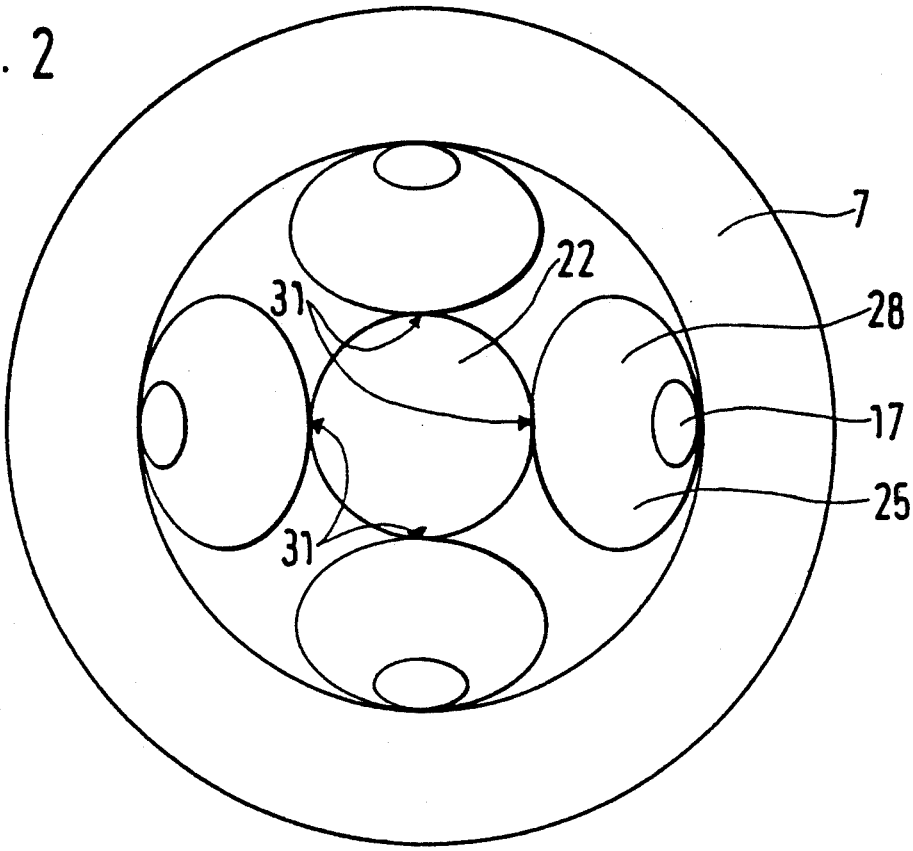

FIG. 2 is a view of the valve cap 7 of the first exemplary embodiment, shown in FIG. 1, in the direction of the arrow X. The cylindrical gas distributor chamber 22 communicates with the narrow gas gaps 28, which taper frustoconically toward the distributor openings 19, each via a respective throttle restriction 31 formed at the transition; because of the major cross-sectional reduction, the throttle restrictions not only effect exact metering of the gas delivered to the distributor openings 19 via the gas gaps 28, but also accelerate the gas. The cross-sectional area of the gas gap 28, which tapers frustoconically downstream, leads to a further acceleration of the gas, so that the fuel emerging from the fuel transport conduit 17 is enveloped by the gas at a high speed.

As a result, first, the formation of a maximally homogenous fuel-gas mixture is facilitated, and second, the fuel injected from the injection ports 15 is transported onward all the way downstream and cannot get through the gas gaps 28 upstream into the gas distributor chamber 22 and into the gas delivery opening 20 or reach the distributor openings 19 of the other cylinders or injection groups of the engine. The fuel-gas mixture is injected via the distributor lines 18 and injection lines, not shown, into the intake tube or directly into the cylinders of the engine.

By way of example, the gas is air diverted through a bypass upstream of a throttle valve in the engine intake tube. However, it is also possible to use recirculated exhaust gas of the engine, to reduce toxic emissions, or some gas (air, exhaust gas) fed by an additional blower.

It is necessary, for instance in order to furnish as identical as possible a mixture to the various engine cylinders, to deliver a constant gas quantity, at as constant a speed as possible, to mixture formation zones 33 formed in the regions of the distributor lines 18 aimed at the injection ports 15 in the vicinity of the various distributor openings 19. The prerequisite for this is the exact, uniform embodiment of the various gas gaps 28. To this end, the valve cap 7 has a collar 35, which rests with a collar face 36 extending at right angles to the longitudinal valve axis 2 on a shoulder face 37 of a shoulder 38 of the distributor housing 10. By its circumference, the collar 35 rests on a parallel portion 39, remote from the gas delivery opening 20, of the longitudinal bore 11 of the distributor housing 10.

The position of the fuel injection valve 1 relative to the valve cap 7 is determined by a circumferentially form-fitting connection between the valve housing 4 of the fuel injection valve 1 and the valve cap 7. To this end, a positioning protrusion 42 is embodied, for instance on a longitudinal bore 41 extending concentrically with the longitudinal valve axis 2 in the valve cap 7; this protrusion cooperates with a positioning recess 43 formed on the circumference of the valve housing 4. This prevents twisting of the fuel injection valve 1 relative to the valve cap 7 and thus simultaneously assures aiming of the injection ports 15 of the injection end 3 at the fuel transport conduits 17 of the valve cap 7.

To assure aiming of the fuel transport conduits 17 of the valve cap 7 at the distributor openings 19 of the distributor housing 10, it is necessary to prevent twisting of the valve cap 7 relative to the distributor housing 10. The circumferentially form-fitting connection between the valve cap 7 and the distributor housing 10 that determines the position of the valve cap 7 relative to the distributor housing 10 is created for instance by a positioning protrusion 45, formed on the parallel portion 39 of the distributor housing 10, and a positioning recess 46 cooperating with it and formed on the circumference of the collar 35 of the valve cap 7.

The injection end 3 is sealed off in a fluid-tight manner from the valve cap 7, and the valve cap 7 is sealed off in a fluid-tight manner from the valve housing 10. To this end, an annular chamber 50 is provided, the radially extending defining faces of which are formed by an end face 51 of the collar 15 of the valve cap 7 formed at right angles to the longitudinal valve axis 2 and remote from the fuel transport conduits 17 and by a retaining ring 52 secured to the circumference of the valve housing 4, and the axially extending defining faces of which are formed by the circumference of the valve housing 4 and by the parallel portion 39 of the valve housing 10. A sealing ring 53 is disposed in the annular chamber 50, by way of example.

Figure 3:
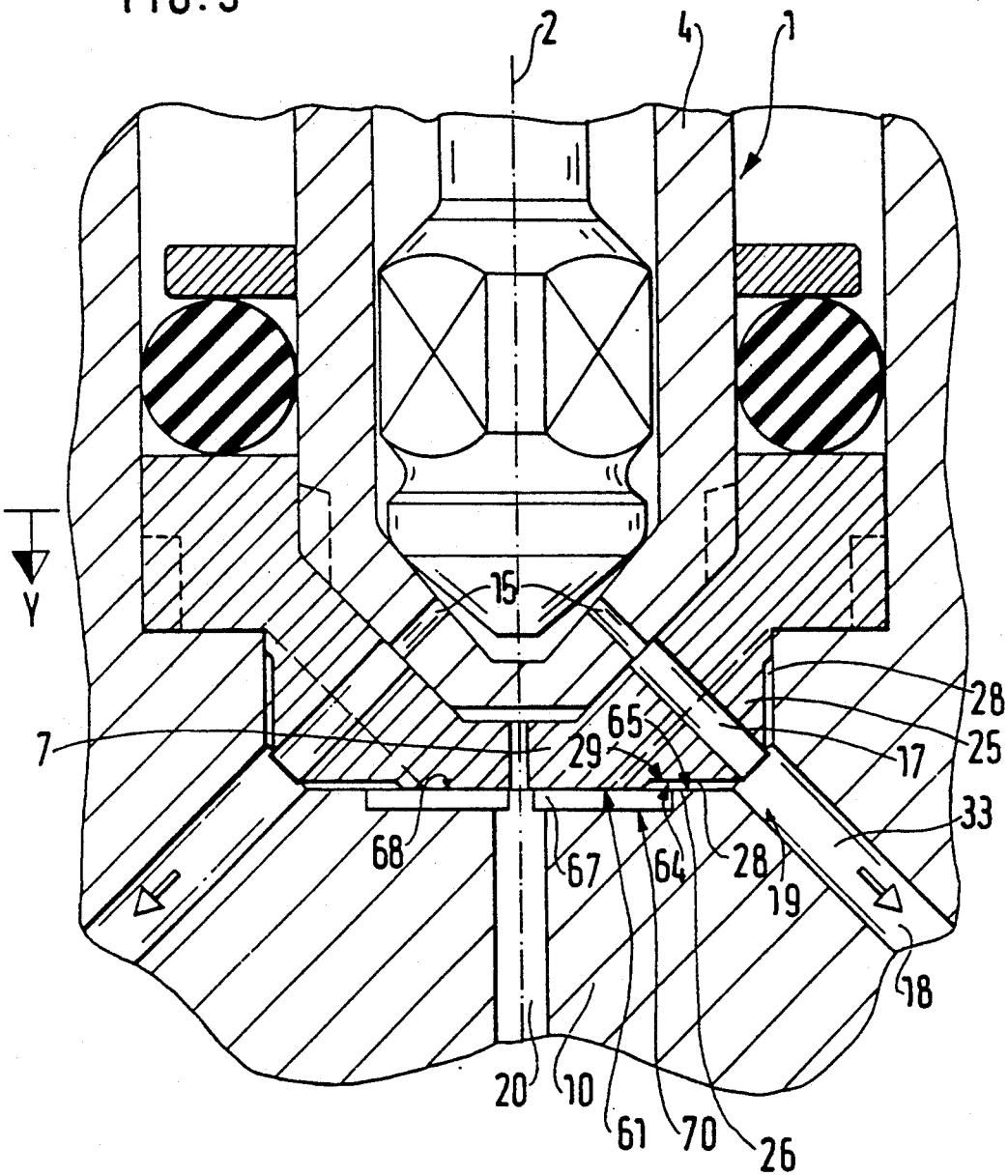

FIG. 3 shows a second exemplary embodiment of the invention with part of a fuel injection valve 1, in which elements that are the same and function the same are identified by substantially the same reference numerals as in FIGS. 1 and 2. In contrast to the first exemplary embodiment, the frustoconical jacket 29 of the projection 25 is stepped. The projection 25 rests with a first step 61 on a wall 65 of the indentation 26 of the distributor housing 10, which enables especially exact, uniform embodiment of the gas gaps 28, so that a maximally identical mixture is thus delivered, for instance to the various cylinders of the engine.

Figure 4:
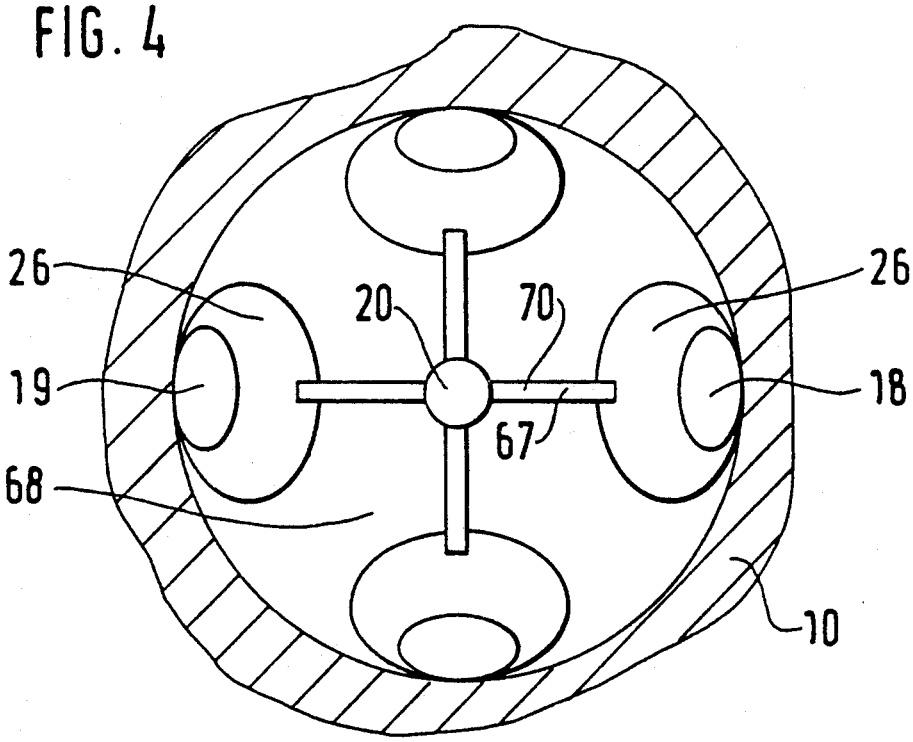

A recessed second step 64 of the projection 25, together with the wall 65 of the indentation 26, forms the gas gap 28. As in FIG. 4, which shows a view of the distributor housing 10 of the second exemplary embodiment in the direction of the arrow Y, one gas conduit 67 each extends in the radial direction between the central gas delivery opening 20 and the various gas gaps 28; this gas conduit 67 is formed between the valve cap 7 and the valve housing 10, each conduit for instance being in the form of one groove 70, which is embodied in a bottom face 68 of the distributor housing 10 and is defined by the projection 25.

The gas conduit 67 may have either a rectangular or some other, for instance semicircular, cross-sectional shape. However, it is necessary that the cross section of the gas conduit 67 be substantially smaller than the cross section of the gas delivery opening 20, so that when the gas flows from the gas delivery opening 20 into the gas conduits 67, throttling occurs; this effects both metering of the gas delivered to the various distributor openings 19 via the gas gaps 28 and acceleration of the gas. The gas gaps 28, tapering frustoconically toward the distributor openings 19, bring about a further acceleration of the gas, so that the fuel emerging from the transport conduit 17, is enveloped by the gas at a high speed.

Figure 5:
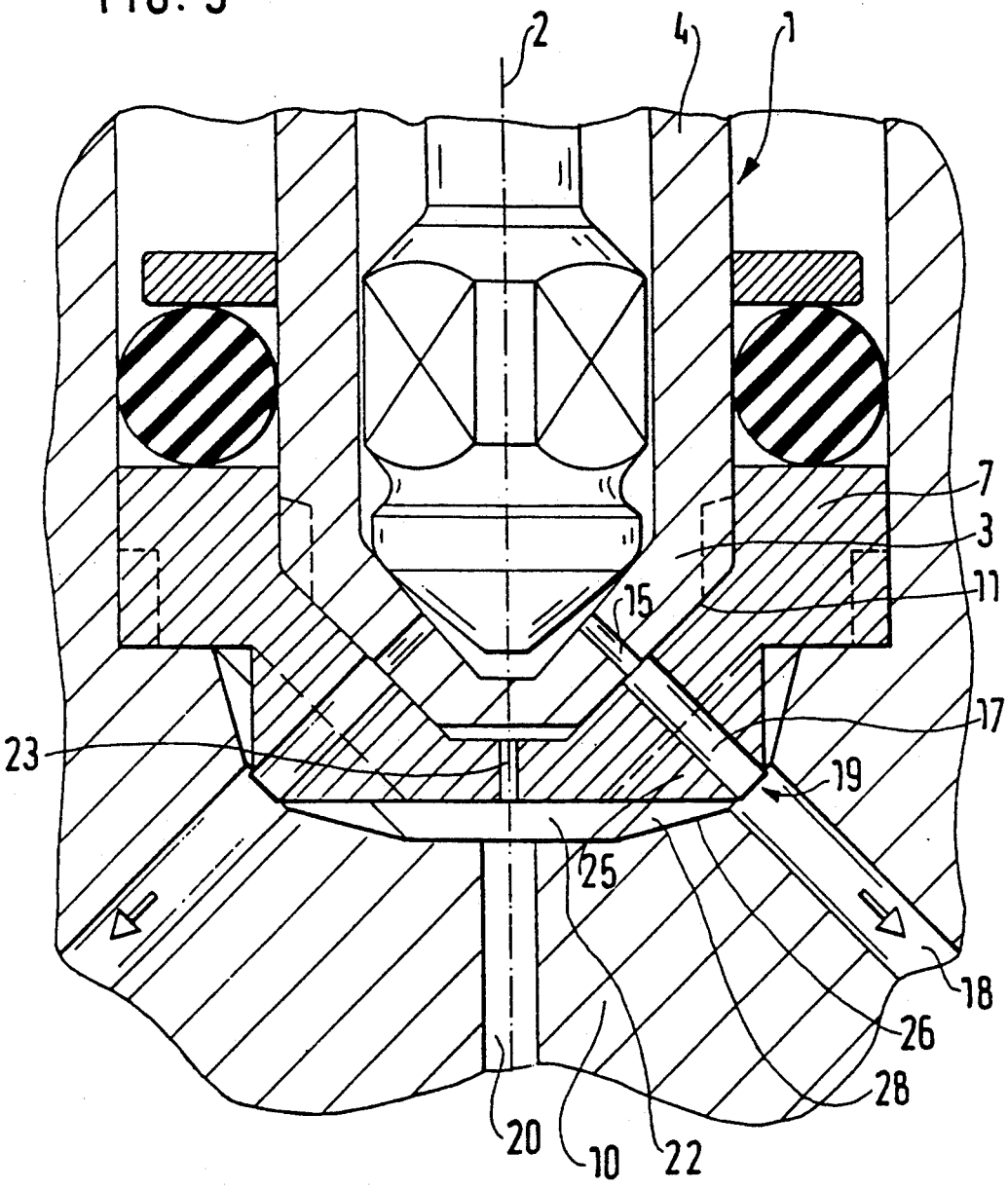

A third exemplary embodiment of the invention is shown in fragmentary form in FIG. 5, in which elements that are the same and function the same are identified by substantially the same reference numerals as in FIGS. 1-4. The encompassing gas gap 28 is formed between the circumference of the frustoconical projection 25 and the surface of the frustoconical indentation 26. Since the cone angle of the projection 25 is smaller than the cone angle of the indentation 26, the circumference of the projection 25 and the surface of the indentation 26 are embodied so that they converge in the direction of the distributor opening 19. The gas gap 28 correspondingly tapers very greatly beginning at the central gas distributor chamber 22 toward the distributor opening 19, resulting in a major, continuous cross-sectional reduction of the gas gap 28. On the one hand, the resulting throttling of the gas flow leads to metering of the gas delivered to the various distributor openings 19; on the other, the gas is accelerated continuously and the fuel emerging from the fuel transport conduit 17 is enveloped by the gas at a high speed. Except in the immediate vicinity of the distributor openings 19, the dimensional and positional tolerances of the projections 25 and the indentations 26 can be designed more generously. The installation of the valve cap 7 in the distributor housing 10 is facilitated as well.

Figure 6:
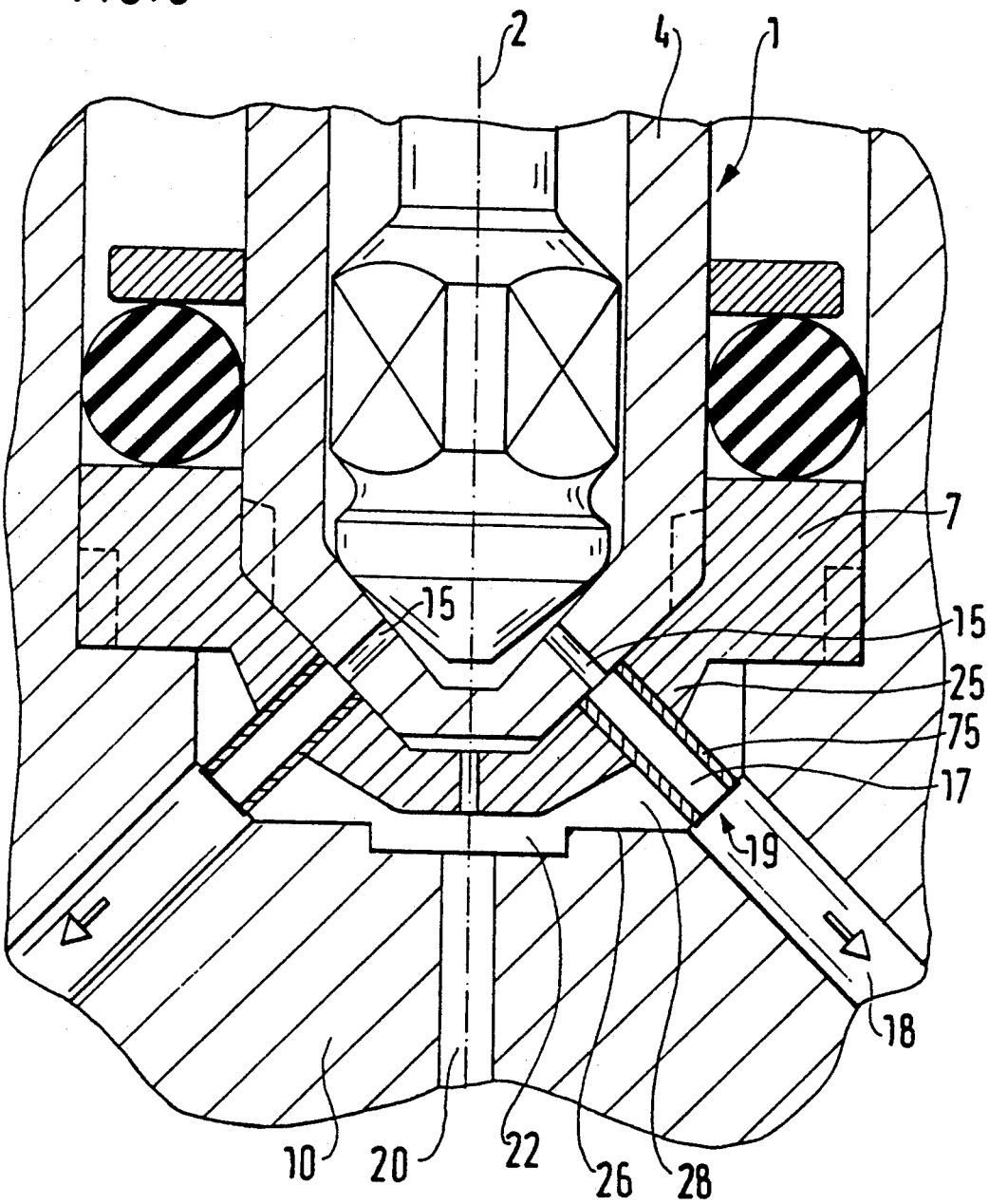

In a fourth exemplary embodiment, shown in part in FIG. 6, elements that are the same and function the same are identified by substantially the same reference numerals as in FIGS. 1–5. The fuel is injected from the injection ports 15 and reaches the distributor openings 19 via the fuel transport conduits 17. Each of the fuel transport conduits 17 is formed by one fuel tubule 75, which leads through the valve cap 7. The fuel tubules 75 are for instance made from tubular material that can be cut to arbitrary lengths, so that they can be made economically. Simple and economical production of the valve cap is also achieved by providing that the fuel tubule 75 protrudes into the indentation 26 of the distributor housing 10, and that the encompassing gas gap 26 is formed between the frustoconical surface of the indentation 26 and the circumference of the fuel tubule 75, so that the demands made in terms of the surface quality of the valve cap 7, at least in the region of the projections 25 that at least still partly surround the fuel tubules 75, are low.

The substantial throttling of the ga takes place as the gas flows through the gas gap 28, which converges in funnel-like fashion, so that both the metering and the acceleration of the gas take place there as well.

It is also possible for the fuel tubules 75 to protrude into the distributor openings 19 of the distributor housing 10, as long as the external diameter of the fuel tubules 75 is smaller than the diameter of the distributor openings 19, so that fuel from the fuel transport conduits 17 cannot get into the gas gaps 28 located farther upstream.

For the sake of simple manufacture, it is also possible for the fuel tubule 75 and the valve cap 7 to be in one piece.

The tedious positioning of the fuel injection valve 1 relative to the valve cap 7 so that the injection ports 15 will be aimed at the fuel transport conduits 17 is simplified if the fuel tubule extends at least partway through the injection end 3 of the valve housing 4.

In the devices according to the invention for injection a fuel-gas mixture, shown in the exemplary embodiments, the fuel is injected in aimed fashion into the distributor openings 19 via the fuel transport conduits 17. The gas flows from one central gas delivery opening 20 via one gas gap 28 to a respective one of the distributor openings 19, where it envelops the fuel at high speed, so that the fuel is transported onward all the way downstream, and a maximally homogenous fuel-gas mixture forms.

The foregoing relates to a preferred exemplary embodiment of the invention, it being understood that other variants and embodiments thereof are possible within the spirit and scope of the invention, the latter being defined by the appended claims.

I claim:

1. A device for injecting a fuel-gas mixture into an intake tube or directly into cylinders of an internal combustion engine, which comprises a fuel injection valve including a valve closing body actuatable as a function of an opening state for delivery of fuel to a number of equally spaced injection ports (15) in an injection end (3) of a valve housing (4), a valve cap (7) is disposed at least in an axial direction between the valve housing (4) and a distributor housing (10), said valve cap (7) includes transport conduits (17) in alignment with said injection ports (15), said injection ports (15) and said transport conduits (17) correspond in number to the number of cylinders, said distributor housing (10) includes an axially aligned gas delivery opening (20) that extends concentrically with a longitudinal valve axis as well as including distributor lines (18) that include distributor openings (19) which are disposed concentrically with the injection ports (15) and transport conduits (17), said injection ports (15) are aimed toward said transport conduits, each of which discharge into one of the distributor openings (19) which is surrounded at least partially by a gas gap (28), said gas gap (28) extends from the gas delivery opening which surrounds and communicates with the distributor openings (19) and discharges gas at a fast rate which is aimed at the transport conduits (17) and the distributor openings (19), which gas surrounds the fuel discharged into each one of the distributor openings (19) from each of the transport conduits (17).

2. A device as defined by claim 1, in which the gas gap (28), at its narrowest point, has a smaller cross-sectional area than the gas delivery opening (20).

3. A device as defined by claim 1, in which the valve cap (7) is provided with a number of frustoconical projections (25), corresponding to the number of distributor openings (19) and each aimed at a respective distributor openings (19), the fuel transport conduits (17) extend through the frustoconical projections and the frustoconical projections protrude into frustoconical indentations (26) of the distributor housing (10) with a spacing such that the at least partially encompassing gas gaps (28) are formed between the circumference of the frustoconical projections (25) and the surface of the indentations (26).

4. A device as defined by claim 1, in which the gas delivery opening (20) communicate with the gas gap (28) through a gas distributor chamber (22) embodied concentrically with the longitudinal valve axis (2) between the injection end and the distributor housing (10).

5. A device as defined by claim 3, in which the smallest diameter portion of the frustoconical projection (25) is smaller than the diameter of the distributor opening (19).

6. A device as defined by claim 5, in which the smallest diameter portion of the frustoconical projection (25) protrudes into the distributor opening (19).

7. A device as defined by claim 3, in which a frustoconical jacket (29) of the frustoconical projection (25) is embodied in stepped fashion and rests with a first step (61) on the frustoconical indentation (26) of the distributor housing (10), and with a second step (64) along with a wall (65) of the frustoconical indentation (26) forms the gas gap (28).

8. A device as defined by claim 7, in which one gas conduit (67) each, extends between the valve cap (7) and the distributor housing (10) that leads from the gas delivery opening (20) to each gas gap (28).

9. A device as defined by claim 3 in which the frustoconical projection (25) includes a cone angle which is smaller than a cone angle of the frustoconical indentation (26).

10. A device as defined by claim 1, in which each of the fuel transport conduits (17) is embodied as a fuel tubule (75) that extends through the valve cap (7).

11. A device as defined by claim 10, in which the fuel tubule (75) extends at least partway through the injection end (3) of the valve housing (4).

12. A device as defined by claim 10, in which the fuel tubule (75) protrudes into the frustoconical indentation (26) of the distributor housing (10), and that the at least partially encompassing gas gap (28) is formed between the surface of the frustoconical indentation (26) and the circumference of the fuel tubule (75).

13. A device as defined by claim 10, in which the outer diameter of the fuel tubule (75) is smaller than the diameter of the distributor opening (19).

14. A device s defined by claim 13, in which the fuel tubule (75) protrudes into the distributor opening (19).

15. A device as defined by one of claim 10 in which the fuel tubules (75) and the valve cap (7) are embodied in one piece.

16. A device as defined by claim 1, in which the injection end (3) of the valve housing (4) is frustoconical and rests on a frustoconical bearing face (6) of the valve cap (7).

17. A device as defined by claim 1, in which the valve cap (7) rests with a collar (35) on a shoulder (38) of the distributor housing (4).

18. A device as defined by claim 1, in which the position of the valve cap (7) with respect to the valve housing (4) is determined by a circumferentially form-fitting connection between the valve cap (7) and the valve housing (4).

19. A device as defined by claim 1, in which the position of the valve cap (7) with respect to the distributor housing (10) is determined by a circumferentially form-fitting connection between the valve cap (7) and the distributor housing (10).

* * * * *